US009614306B2

(12) United States Patent
Hewer et al.

(10) Patent No.: US 9,614,306 B2
(45) Date of Patent: Apr. 4, 2017

(54) PRINTED CIRCUIT BOARD TERMINAL

(71) Applicant: MCQ TECH GmbH, Blumberg (DE)

(72) Inventors: Patrick Hewer, Blumberg (DE); Hermann Stadler, Donaueschingen (DE)

(73) Assignee: MCQ TECH GmbH, Blumberg (DE)

( * ) Notice: Subject to any disclaimer, the term of this patent is extended or adjusted under 35 U.S.C. 154(b) by 0 days.

(21) Appl. No.: 14/934,321

(22) Filed: Nov. 6, 2015

(65) Prior Publication Data

US 2016/0134035 A1 May 12, 2016

(30) Foreign Application Priority Data

Nov. 7, 2014 (DE) ..... 10 2014 116 237

(51) Int. Cl.

| | |
|---|---|
| ***H01R 11/20*** | (2006.01) |
| ***H01R 4/24*** | (2006.01) |
| ***H01R 4/26*** | (2006.01) |
| ***H01R 12/70*** | (2011.01) |
| ***H01R 12/51*** | (2011.01) |
| ***H01R 12/71*** | (2011.01) |
| ***H01R 13/42*** | (2006.01) |
| *H01R 4/48* | (2006.01) |
| *H01R 13/514* | (2006.01) |

(52) U.S. Cl.

CPC ..... *H01R 12/7005* (2013.01); *H01R 12/515* (2013.01); *H01R 12/716* (2013.01); *H01R 13/42* (2013.01); *H01R 4/4836* (2013.01); *H01R 13/514* (2013.01)

(58) Field of Classification Search

CPC H01R 12/7005; H01R 12/515; H01R 12/716; H01R 12/70; H01R 13/42; H01R 13/514; H01R 4/4836

USPC ..... 439/441, 660, 733.1

See application file for complete search history.

(56) References Cited

U.S. PATENT DOCUMENTS

| | | | | |
|---|---|---|---|---|
| 5,409,407 A * | 4/1995 | Mizuno | ..... | H01R 13/113 439/441 |
| 5,453,028 A | 9/1995 | Grambley et al. | | |
| 5,535,513 A | 7/1996 | Frantz | | |
| 7,780,468 B1 | 8/2010 | Bishop | | |

FOREIGN PATENT DOCUMENTS

| | | |
|---|---|---|
| EP | 2 434 581 A1 | 3/2012 |
| WO | WO 00/31830 A1 | 6/2000 |

* cited by examiner

*Primary Examiner* — Javaid Nasri
(74) *Attorney, Agent, or Firm* — Juneau & Mitchell

(57) ABSTRACT

The invention is a printed circuit board terminal, having a housing which has an inner wall and outer wall, a clamp spring, a contact element arranged inside the housing, and a connector element arranged outside the housing, wherein the contact element and the connector element are conductively connected to each other, and wherein the contact element is arranged flush with the inner wall and the connector element is arranged flush with the outer wall.

23 Claims, 8 Drawing Sheets

PRINTED CIRCUIT BOARD TERMINAL

CROSS REFERENCE TO RELATED APPLICATIONS

This patent application claims priority to German Patent Application 10 2014 116 237.4, filed on Nov. 7, 2014.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to a printed circuit board terminal.

Background of the Invention

Printed circuit board terminals are known which have a clamp spring arranged in a housing for the purpose of fixing an electrical conductor which is inserted into the housing. In addition, a contact element is arranged inside the housing, and has an electrically conducting connection to a connector element arranged outside the housing. The clamp spring in the known printed circuit board terminals presses the electrical conductor against the contact element. The electrically conducting connection between the inserted electrical conductor and the printed circuit board can be produced via the connector element, which can either be directly soldered to a printed circuit board, or can be attached to the printed circuit board by means of a pin. In known printed circuit board terminals, the contact element is generally a complex punched/bended part with multiple surfaces angled with respect to each other, said part also particularly supporting a contact leg of the clamp spring inside the housing.

The problem addressed by the invention is that of providing a more cost-effective printed circuit board terminal.

The problem is addressed according to the invention by a printed circuit board terminal having the features described herein.

BRIEF SUMMARY OF THE INVENTION

In a preferred embodiment, a printed circuit board terminal, having a housing which has an inner wall and an outer wall, a clamp spring, a contact element arranged inside the housing, and a connector element arranged outside the housing, wherein the contact element and the connector element are conductively connected to each other, wherein the contact element is arranged flush with the inner wall and the connector element is arranged flush with the outer wall.

In another preferred embodiment, the printed circuit board terminal as described herein, wherein the contact element and the connector element are arranged at least partially, and preferably to a large degree or entirely, in planes which are parallel to each other.

In another preferred embodiment, the printed circuit board terminal as described herein, wherein the contact element lies flush on a single side wall of the housing and/or the connector element lies flush on a single side wall of the housing, wherein the contact element and the connector element preferably lie on the same side wall of the housing.

In another preferred embodiment, the printed circuit board terminal as described herein, wherein the contact element and the connector element are connected to each other as a single piece.

In another preferred embodiment, the printed circuit board terminal as described herein, wherein the contact element and the connector element are designed as punched/bended elements.

In another preferred embodiment, the printed circuit board terminal as described herein, wherein a strap, a projection, a tab, or another raised contour, or a depression, is arranged on the contact element.

The printed circuit board terminal according to one of the previous claims, wherein the contact element and/or the connector element are formed by a metallic surface attached to the housing.

In another preferred embodiment, the printed circuit board terminal as described herein, wherein the metallic surface is generated galvanically, chemically, by painting, or by applying a thin metal film, for example by gluing.

In another preferred embodiment, the printed circuit board terminal as described herein, wherein the connector element and the contact element form legs of a U-shaped element or a Z-shaped element.

In another preferred embodiment, the printed circuit board terminal as described herein, wherein the housing is open to one side, and this side can be covered by a cover, wherein the electrically conducting connection between the contact element and the connector element is guided between the housing and the cover through a slot.

In another preferred embodiment, the printed circuit board terminal as described herein, wherein the cover is formed by an adjacent housing of a further printed circuit board terminal.

In another preferred embodiment, the printed circuit board terminal as described herein, further comprising wherein the housing has a plug opening for an electrical conductor to be connected.

In another preferred embodiment, the printed circuit board terminal as described herein, further comprising wherein the housing has an actuating element, by means of which the clamp spring can be displaced against the spring force.

In another preferred embodiment, the printed circuit board terminal as described herein, wherein the clamp spring is made of a metal.

In another preferred embodiment, the printed circuit board terminal as described herein, wherein a solder pin is arranged as a single piece on the connector element.

In another preferred embodiment, a connector socket comprising at least one printed circuit board terminal as described herein, wherein the connector socket has a connector socket housing which is designed to be open to one side, and which has at least one metal contact which has a first section and a second section, wherein the first section is arranged inside the connector socket housing, and when a printed circuit board terminal is inserted, lies flush on the connector element of the printed circuit board terminal, wherein the second section is guided outward through an opening of the connector socket housing, forming a solder connection for a printed circuit board.

In another preferred embodiment, the connector socket as described herein, further comprising wherein multiple metal contacts are arranged in the connector socket housing, and it is possible to plug multiple printed circuit board terminals according to claim 1, preferably adjoining each other, into the connector socket, wherein each of the printed circuit board terminals is contacted by one metallic contact.

In another preferred embodiment, the connector socket as described herein, wherein the first section has a spring-elastic design.

In another preferred embodiment, the connector socket as described herein, wherein the first section has a spherical design.

In another preferred embodiment, the connector socket as described herein, wherein the opening through which the second section of the metallic contact is guided outward is arranged either in the rear wall which is opposite the open side, or in a side wall adjacent to the open side.

In another preferred embodiment, the connector socket as described herein, further comprising wherein one opening is arranged in the rear wall which is opposite the open side, and one opening is arranged in at least one of the side walls adjacent to the open side, wherein the second section of the metallic contact can be guided outward through the same.

In another preferred embodiment, the connector socket as described herein, wherein the printed circuit board terminal can be locked in the connector socket.

In another preferred embodiment, the connector socket as described herein, wherein the connector socket housing has pins for positioning on the printed circuit board.

DETAILED DESCRIPTION OF THE INVENTION

Figure 1:
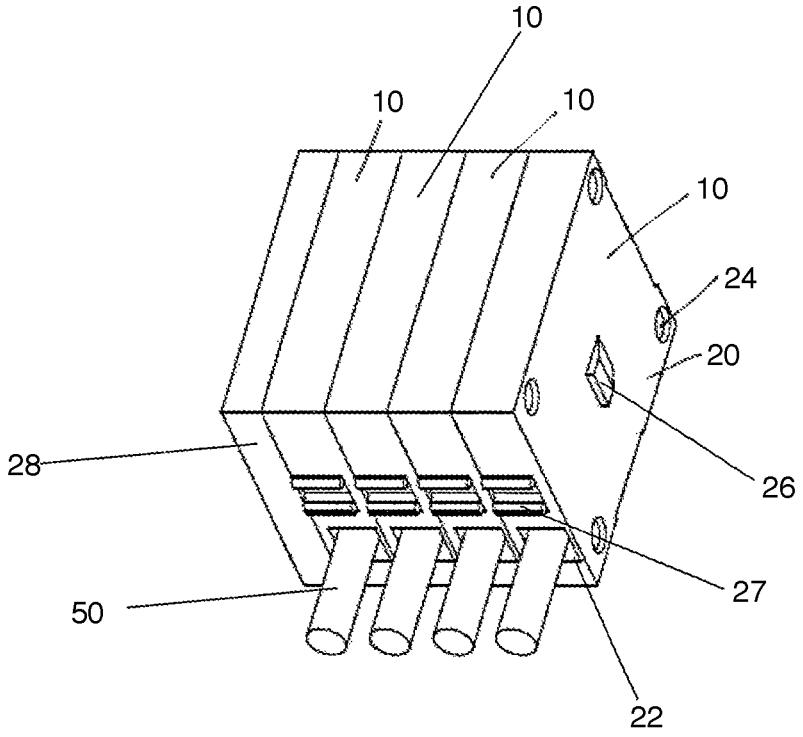
FIG. 1 is a line drawing evidencing a perspective view of multiple printed circuit board terminals according to the invention, according to a first embodiment.

The printed circuit board terminal according to the invention, having a housing which has an inner wall and an outer wall, a clamp spring, a contact element arranged inside the housing, and a connector element arranged outside the housing, wherein the contact element and the connector element are conductively connected to each other, is characterized in that the contact element is arranged flush with the inner wall and the connector element is arranged flush with the outer wall. The contact element is substantially formed by a single surface which is substantially flat, which is connected to the connector element via a connecting element. The connector element is likewise designed as a substantially flat surface. As a result, there is no need for a complex contact element with multiple surfaces angled with respect to each other, and the printed circuit board terminal can therefore be produced more cheaply.

The contact element and the connector element are advantageously at least partially, and preferably to a large degree or even entirely, arranged in planes which are parallel to each other, which further simplifies the manufacture thereof.

The contact element preferably sits flush on a single side wall of the housing, and/or the connector element preferably sits flush on a single side wall of the housing, wherein the contact element and the connector element preferably sit flush on the same side wall, but on opposite surfaces of the side wall, of the housing. A particularly more space-saving, compact, and consequently more cost-effective construction results.

According to a particularly advantageous embodiment of the invention, the contact element and the connector element are connected to each other as a single piece. This further simplifies the manufacturing thereof.

The contact element and the connector element can advantageously be designed as a punched/bended element, wherein particularly fewer bending processes are needed in comparison to conventional contact elements with connector elements arranged on the same.

In one advantageous implementation of the invention, a strap, a projection, a nose, or another raised contour, or a depression, is arranged on the contact element, such that it is thereby possible to increase the electrical contact between an inserted electrical conductor and the contact element, and to increase the wire extraction force.

The contact element and/or the connector element are preferably formed by a metallic surface applied to the housing. Such a metallic surface can be generated, by way of example, galvanically, chemically, by painting, or by applying a thin metal film, for example by gluing. Such metallic surfaces are fixed to the housing, thereby making the same loss-proof.

The connector element and the contact element preferably form legs of an element which is substantially U-shaped or substantially Z-shaped, and which can be easily produced.

In one preferred embodiment of the invention, the housing is open to one side, and this side can be covered by a cover, wherein the electrically conducting connection between the contact element and the connector element is guided through the housing and the cover by a slot. Such a slot is particularly simple and cost-effective to produce. The open housing also makes possible a simple attachment of the contact element before the housing is closed by the cover.

The cover is advantageously formed by an adjacent housing of a further printed circuit board terminal. This is particularly the case when printed circuit board terminals are arranged in a row, and enables a simple and cost-effective, space-saving arrangement of multiple printed circuit board terminals next to each other.

The housing particularly has a plug opening for an electrical conductor to be connected. In this case, the clamp spring is advantageously positioned relative to the plug opening in such a manner that when the electrical conductor is inserted through the plug opening, the clamp spring opens against the spring force, and when the electrical conductor is further inserted through the clamping legs, the clamp spring is fixed and clamps.

The housing preferably has an actuating element by means of which the clamp spring can be displaced against the spring force. Such an actuating element particularly makes it possible to easily release the clamping hold on the electrical conductor.

The clamp spring is preferably made of a metal so that, on the one hand, the clamp spring is given sufficient stability, and on the other hand the configuration ensures a cost-effective manufacture of the clamp spring.

A solder pin can advantageously be arranged as a single piece on the connector element in order to enable a design of the printed circuit board terminals which is adapted for through-hole techniques.

In one alternative, preferred embodiment, for the purpose of providing a pluggable printed circuit board terminal according to the invention, there is a connector socket in which is inserted at least one printed circuit board terminal according to the invention, wherein the connector socket has a connector socket housing which is designed to be open to one side, and which has at least one metal contact which has a first section and a second section, wherein the first section is arranged inside the connector socket housing, and when a printed circuit board terminal is inserted, said first section lies flush on the contact element of the printed circuit board terminal, wherein the second section is guided out through an opening of the connector socket housing, forming a solder connection for a printed circuit board. The solder connection can be designed as a solder surface or as a solder pin, and can be accordingly soldered to the printed circuit board with a surface-mounting or through-hole technique (SMT or THT). It is possible to produce a pluggable printed circuit board terminal in a simple manner by the insertion of a printed circuit board terminal, having a solder surface, into such a connector socket.

In one advantageous implementation of the connector socket, multiple metal contacts are arranged in the connector socket housing, and it is possible to plug multiple printed circuit board terminals according to the invention, advantageously arranged next to each other in a row, into the connector socket, wherein each of the printed circuit board terminals is contacted by one metallic contact. This makes it possible to design multiple, directly solderable printed circuit board terminals as pluggable printed circuit board terminals.

According to one particularly preferred embodiment of the invention, the first section has a spring-elastic design in order to enable a secure electrically-conducting contact between the metallic contact of the connector socket and the connector element of the printed circuit board terminal.

According to one particularly preferred embodiment of the invention, the first section has a spherical design in order to enable a secure contact.

The opening through which the second section of the metallic contact is guided outward is preferably arranged in the rear wall, which is opposite the open side, or in a side wall adjacent to the open side, in order to enable various relative orientations between the printed circuit board and the plugging direction.

It is particularly preferred that one opening is arranged in the rear wall which is opposite the open side, and one opening is arranged in each of the side walls adjacent to the open side, wherein the second section of the metallic contact can be guided outward through said openings in order make it possible to dispense with the need for two different embodiments of the housing of the connector socket for different relative orientations between the printed circuit board on which the connector socket is mounted and the plugging direction.

The printed circuit board terminal can preferably be locked in the connector socket in order to enable a secure fixing thereof.

The connector socket housing advantageously has pins for the purpose of positioning the printed circuit board in order to make it possible to fix the relative orientation between the connector socket and the printed circuit board.

DETAILED DESCRIPTION OF THE FIGURES

Figure 2:
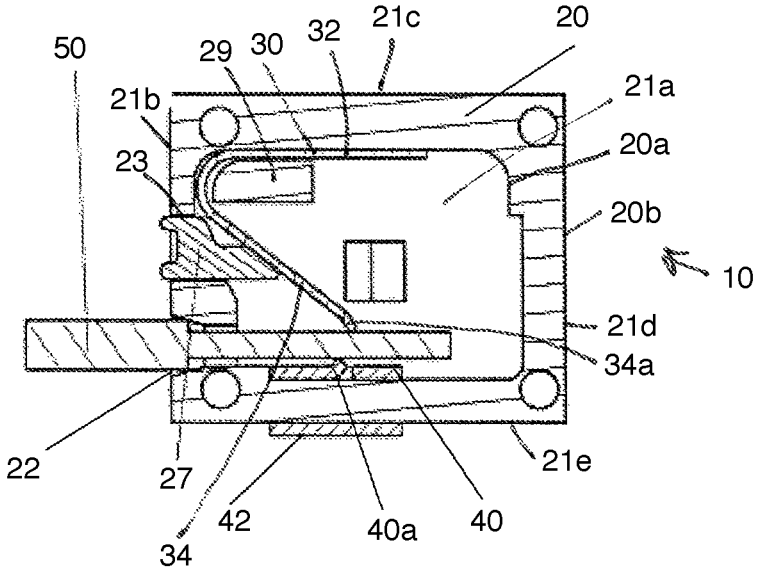
FIG. 2 is a line drawing evidencing a cutaway view of one of the printed circuit board terminals in FIG. 1.
Figure 3:
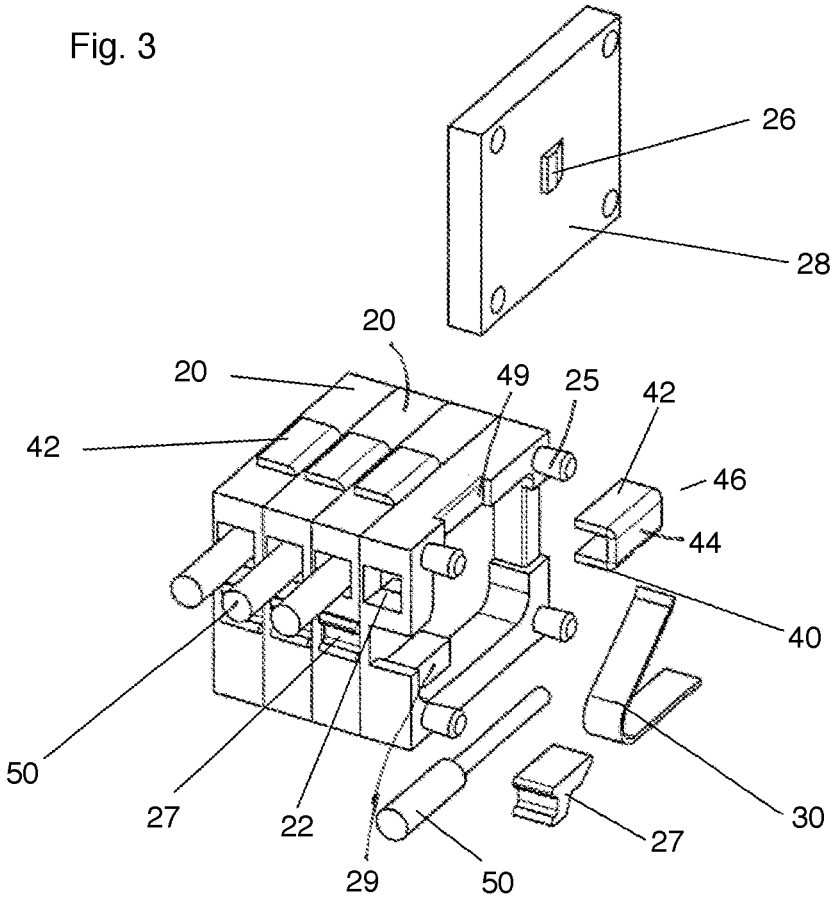
FIG. 3 is a line drawing evidencing a partially exploded view of the printed circuit board terminals arranged in a row next to each other, according to FIG. 1.

FIGS. 1, 2 and 3 show various views of one embodiment of a printed circuit board terminal 10. The printed circuit board terminal 10 has a housing 20 with an inner wall 20*a* and an outer wall 20*b*. The housing 20 has a rear wall 21*a*, wherein four side walls 21*b*, 21*c*, 21*d*, 21*e* adjoin the same preferably at right angles. The side opposite the rear wall 21*a* is open and can be covered by a cover 28. As an alternative, the open side can also be covered by an adjacent housing 20, particularly the rear wall 21*a* thereof. The result is a printed circuit board terminal 10 which can be added to in a row. To make it possible to connect adjacent housings 20 to each other, multiple recesses 24 are arranged on the housing 20, on the outer wall 20*b* of the rear wall 21*a*, while multiple pins 25 are arranged on the open end faces of the housing 20. The housings 20 can therefore be arranged adjacent to each other in such a manner that the recesses 24 of one of the housings 20 receive the pins 25 of a different housing 20. The housing 20 which is positioned on the side on which no further printed circuit board terminals 10 will be arranged can be closed with the cover 28.

A plug opening 22 is arranged in the housing 20 of the printed circuit board terminal 10, wherein an electrical conductor 50 can be inserted into the housing 20 through the same. The plug opening 22 is on the side wall 21*b*, for example.

A clamp spring 30 is arranged in the interior of the housing 20. The clamp spring 30 has a contact leg 32 and a clamping leg 34, particularly arranged at an acute angle to each other such that the clamp spring 30 overall has a V-shaped design. The clamp spring 30 can be fixed in the housing 20 in a suitable manner, for example by a projection 29 which is arranged in the interior of the housing 20, by way of example on the rear wall 21*a*, in such a manner that a fixing slot is formed between the projection 29 and one or two of the side walls 21*b*, 21*c*, 21*d*, 21*e*. The contact leg 32 of the clamp spring 30 lies in this case directly against the inner wall 20*a* on one of the side walls, for example side wall 21*c*. A free end 34*a* of the clamping leg 34 of the clamp spring 30 projects into the interior space of this housing 20 in such a manner that the electrical conductor 50 inserted into the housing 20 through the plug opening 22 can displace the clamping leg 34 against the spring force, and then fix the free end 34*a* by clamping. So that it is possible to release the clamping hold, in one embodiment, an actuating element 27 can be inserted into an actuating opening 23 of the housing 20 in such a manner that, when pressure is applied to the actuating element 27, the clamping leg 34 is pushed back against the spring force of the clamp spring 30 to then release the electrical conductor 50 fixed by clamping.

A contact element 40 is arranged inside the housing 20, flush against the inner wall 20*a*. The contact element 40 is designed in particular as a rectangular and substantially flat surface, and particularly lies against only one of the side walls—for example side wall 21*e*. The contact element 40 can have a small, drawn strap 40*a* as in the embodiment illustrated in FIG. 2. The electrical conductor 50 is pressed by the clamping leg 34 of the clamp spring 30 against the contact element 40. The electrically conducting contact is established by the conductor 50 touching the contact element 40, and can be improved by the strap 40*a*. The strap 40*a* can also increase the wire extraction force. Aside from the strap 40*a* or another tab, contour, projection, or depression, which can be constructed on the contact element 40 as an alternative to the strap 40*a*, the contact element 40 has a flat design and particularly only lies against the side walls 21*b*, 21*c*, 21*d*, 21*e*. The contact element 40 particularly has no angled surfaces which are oriented parallel to the rear wall 21*a* and to the side wall 21*c*—opposite the side wall 21*e*—on which lies the contact leg 32 of the clamp springs 30, and therefore does not have a cage-like structure.

The housing 20 furthermore has a connector element 42 which is designed to lie flush against the outer wall 20*b* of the housing 20. A solder pin can be arranged on the connector element 42. However, the connector element 42 is preferably designed as a flat surface which is particularly oriented parallel to the plane of the contact element 40, and advantageously is arranged lying against the same side wall 21*e* as the contact element 40. The electrically conducting contact to a printed circuit board can be established via the connector element 42.

The connector element 42 and the contact element 40 are connected to each other conductively, particularly by means of a connecting element 44. In the embodiment shown in FIGS. 1 to 3, the connecting element 44 is substantially perpendicular to the planes of the contact element 40 and the connector element 42, resulting in a particularly U-shaped element 46. Such a U-shaped element 46 can be pushed onto the side wall 21*e* in such a manner that the contact element 40 comes to lie against the inner wall 20*a* and the connector element 42 comes to lie against the outer wall 20*b* of the side wall 21*e*. So that the housing 20 can be covered by the cover 28 or an adjacent housing 20, the side wall 21*e* is advantageously shortened in such a manner that a slot 49 is formed between the housing 20 and the cover 28 and/or the adjacent housing 20 in the region in which the U-shaped element 46 is pushed onto the side wall 21*e*, wherein the connecting element 44 comes to lie in said slot [49]. The contact element 40 and the connector element 42 in this case are particularly arranged opposite each other on the side wall 21*e*. The free ends of the contact element 40 and the connector element 42, facing away from the connecting element 44, face the rear wall 21*a* when arranged in the housing 20.

Figure 4:
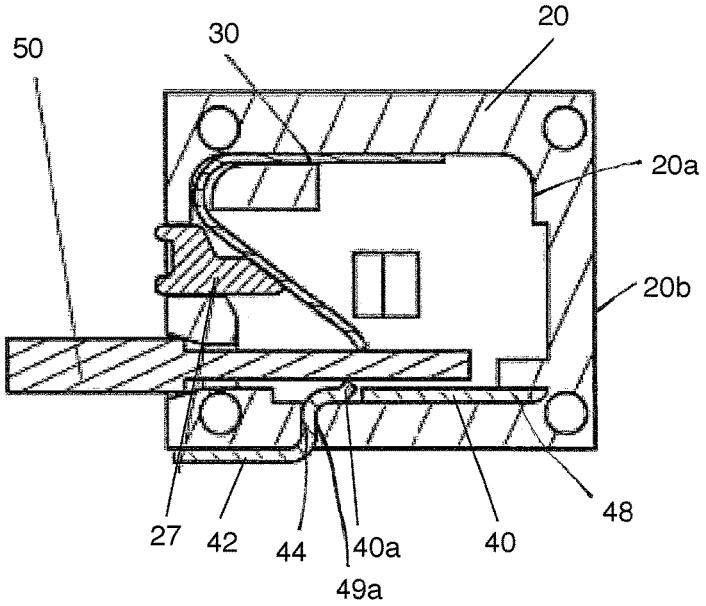
FIG. 4 is a line drawing evidencing a cutaway view of an alternative embodiment of a printed circuit board terminal according to the invention.

FIG. 4 shows a further embodiment of a printed circuit board terminal 10, which differs from the embodiment shown in FIGS. 1 to 3 by the geometry of the contact element 40, the connector element 42, and the connecting element 44. The contact element 40 is again designed as a flat surface aside from the strap 40*a* or another contour for the purpose of increasing the wire extraction force, and lies against the inner wall 20*a* of the side wall 21*e*. The connector element 42 is arranged flush with the outer wall 20*b* of the same side wall 21*e*—however, this time preferably not opposite the contact element 40. The contact element 40 and the connector element 42 are connected to each other via the connecting element 44 in such a manner that a nearly S- or Z-shaped element 48 results. The connecting element 44 comes to lie in a slot 49*a* which is arranged in the side wall 21*e*. The slot 49*a* has an elongation, particularly in the direction which is perpendicular to the rear wall 21*a*, which is greater than the elongation of the slot 49 perpendicular to the rear wall 21*a* of the embodiment shown in FIGS. 1 to 3. The elongation of the slot 49*a* in the direction parallel to the side wall 21*e*, particularly parallel to the insertion direction of the electrical conductor 50, corresponds to the thickness of the contact element 40 and of the connecting element 44. In this embodiment, the free end of the contact element 40 which faces away from the connecting element 44 faces the side wall 21*d*, while the free end of the connector element 42 which faces away from the connecting element 44 faces the side wall 21*b*.

Figure 5:
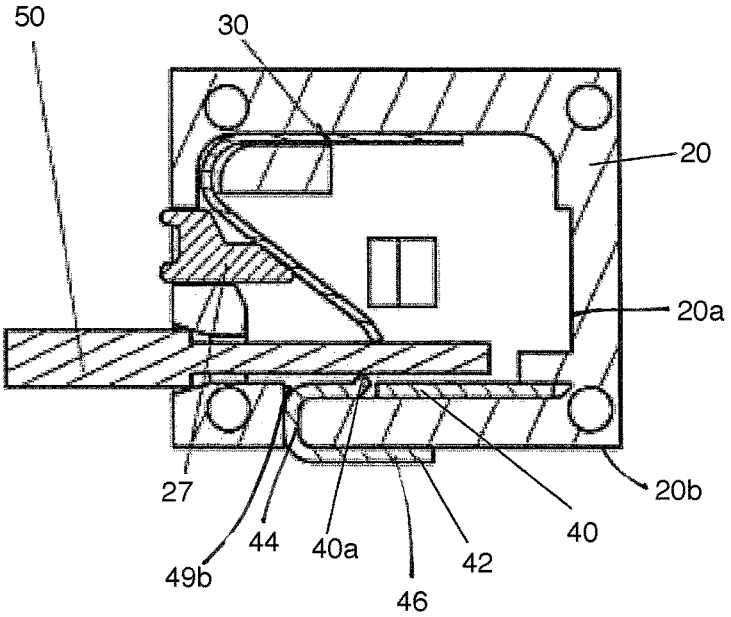
FIG. 5 is a line drawing evidencing a cutaway view of a further alternative embodiment of a printed circuit board terminal according to the invention.

FIG. 5 shows a further embodiment of a printed circuit board terminal 10, which differs from the embodiment shown in FIG. 4 by the geometry of the contact element 40, the connector element 42, and the connecting element 44. The contact element 40 and the connector element 42 again form, together with the connecting element 44, a U-shaped element 46, which, however, is inserted into a slot 49*b* of the side wall 21*e* in such a manner that the free ends of the contact element 40 and the connector element 42 which face away from the connecting element 44 both face one of the side walls which adjoins the side wall 21*e*—in particular the side wall 21*d*. As can particularly be seen in the embodiment shown in FIG. 5, the surfaces of the contact element 40 and of the connector element 42 need not necessarily be the same size, nor must the legs of the U-shaped element 46 necessarily be the same length.

In the examples described above, the contact element 40, the connector element 42, and the connecting element 44 are designed as separate components, in particular as a single-piece punched/bended part which can be pushed onto the side wall 21*e*.

Figure 6:
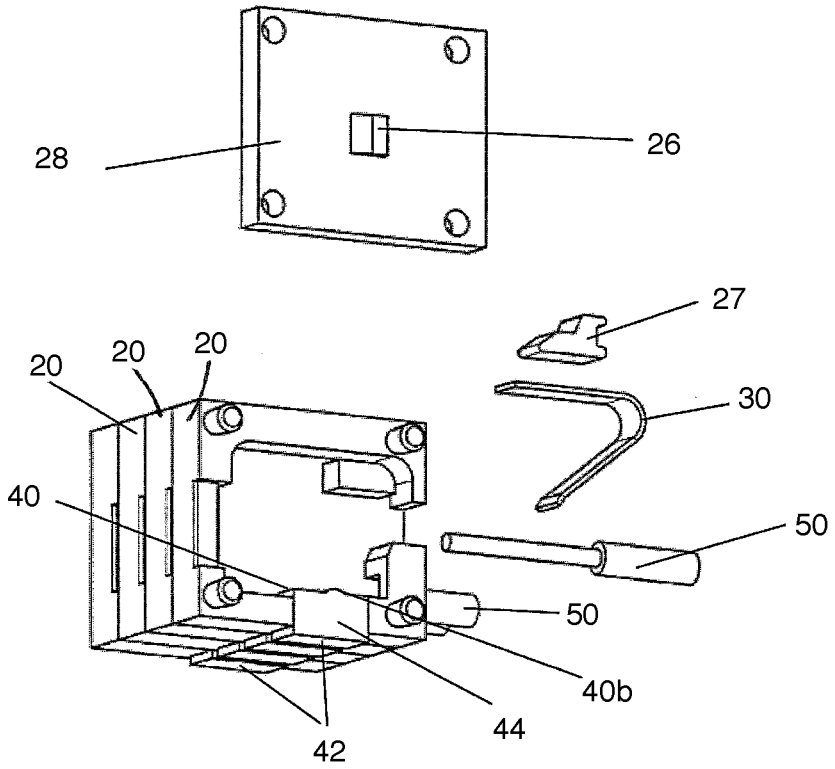
FIG. 6 is a line drawing evidencing a partially exploded view of a further embodiment of printed circuit board terminals according to the invention.
Figure 7:
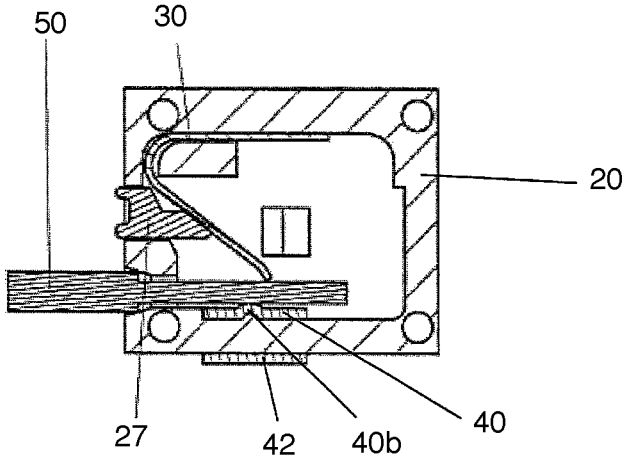
FIG. 7 is a line drawing evidencing a cutaway view of one of the printed circuit board terminals in FIG. 6, in an assembled state.

As an alternative, the contact element 40, the connector element 42, and the connecting element 44 can be formed by a metallic surface attached to the housing 20, as illustrated in FIGS. 6 and 7, which show a further embodiment of a printed circuit board terminal 10. Such a metallic surface can be designed as a molded interconnected device (MID). Such a metallic surface can be generated, by way of example, galvanically, chemically, by painting, or by applying a thin metal film, for example by gluing. Such a metallic surface can have the geometries corresponding to the embodiments described above. The geometry illustrated in FIGS. 6 and 7 is particularly comparable to the geometry illustrated in FIGS. 1 to 3.

In place of the exposed strap 40*a* according to the embodiment shown in FIGS. 1 to 3, the contact element 40 in the embodiment shown in FIGS. 6 and 7 can have a metalized edge 40*b* which is formed either by applying additional metallic material, or by a tab constructed in advance in the side wall 21*e*, which is coated with metal.

Figure 8:
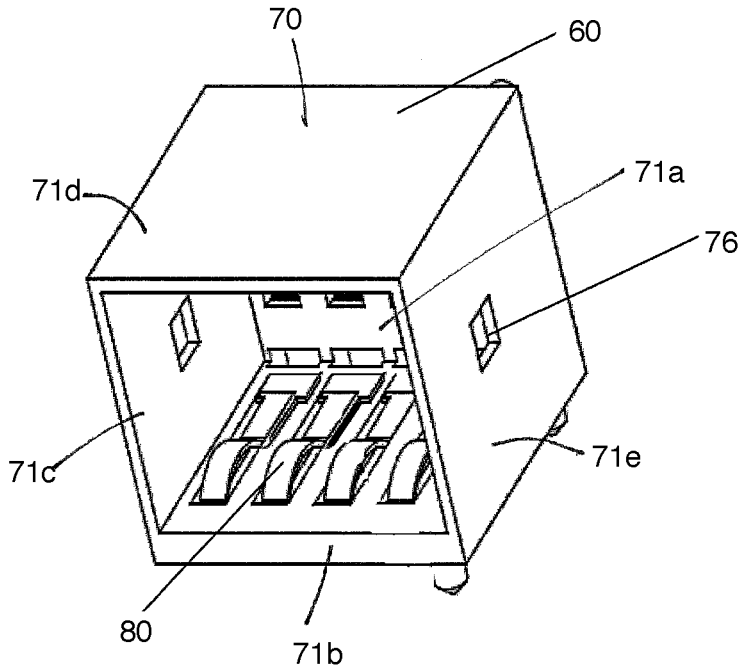
FIG. 8 is a line drawing evidencing one embodiment of a connector socket according to the invention.
Figure 9:
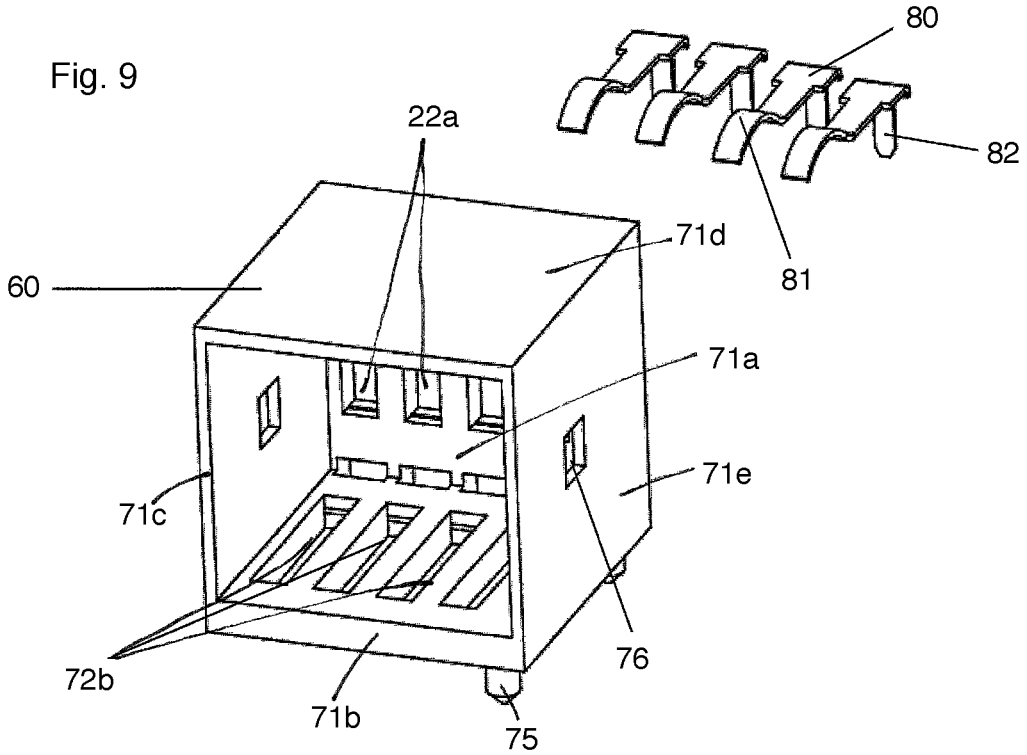
FIG. 9 is a line drawing evidencing an exploded view of the connector socket according to FIG. 8.

FIGS. 8 and 9 show different views of a connector socket 60, wherein printed circuit board terminals 10 according to the described embodiment or further alternatives can be inserted into the same. The connector socket 60 has a connector socket housing 70 which has a rear wall 71*a* and four side walls 71*b*, 71*c*, 71*d*, 71*e* arranged substantially perpendicular to the rear wall 71*a*. The connector socket housing 70 is open to the side opposite the rear wall 71*a*.

The connector socket 70 has at least one, and advantageously multiple, metallic contacts 80 which each have a first section 81 and a second section 82. The metallic contact 80 is arranged in such a manner that the first section is arranged inside the connector socket housing 70, and the second section 82 is guided outward through an opening 72*a*, 72*b*, and forms a solder pin for a printed circuit board. The connector socket housing 70 has one opening 72*a*, 72*b*, at least for each of the metallic contacts 80, which is positioned either in the rear wall 71*a* or one of the side walls—for example the side wall 71*b*. One opening 72*a* is advantageously arranged in the rear wall 71*a*, and one opening 72*b* is advantageously arranged in the side wall 71*b*, for each metallic contact 80, in order to make it possible to insert the metallic contact 80 into the desired opening 72*a*, 72*b* depending on the application and desired orientation of the plug direction relative to the printed circuit board on which the connector socket housing 70 is mounted.

In the embodiment shown in FIGS. 8 and 9, the metallic contacts 80 are inserted into the openings 72*b* which are arranged in the side wall 71*b*. The first section 81 has a particularly spring-elastic design, and can preferably have a spherical design.

So that it is possible to fix the connector socket 60 on a printed circuit board in a desired position, the connector socket housing 70 advantageously has one or more pins 75.

Figure 10:
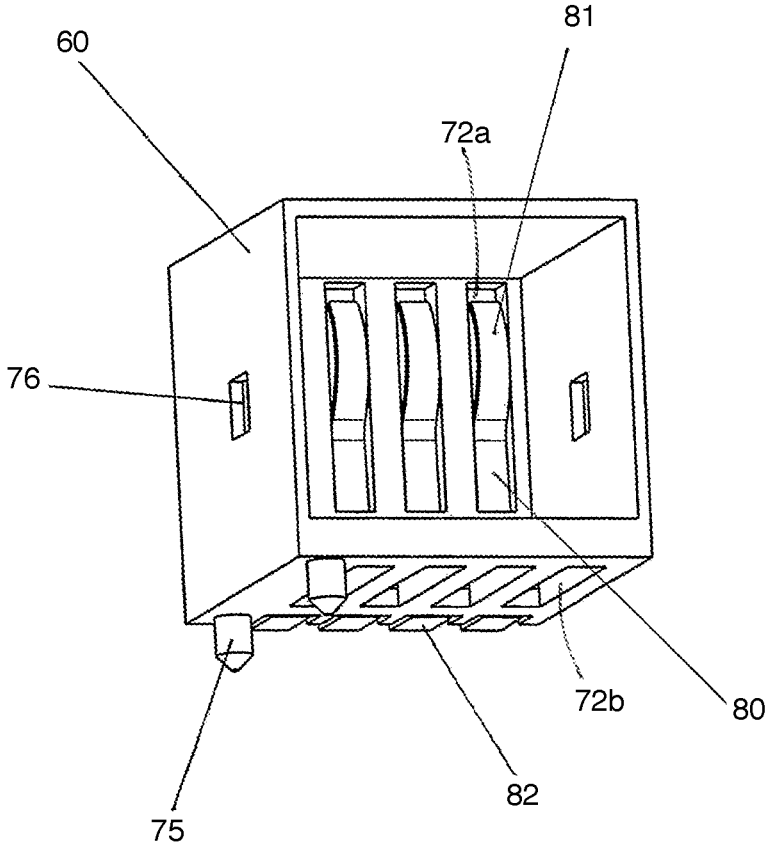
FIG. 10 is a line drawing evidencing a perspective view of a further embodiment of a connector socket according to the invention.
Figure 11:
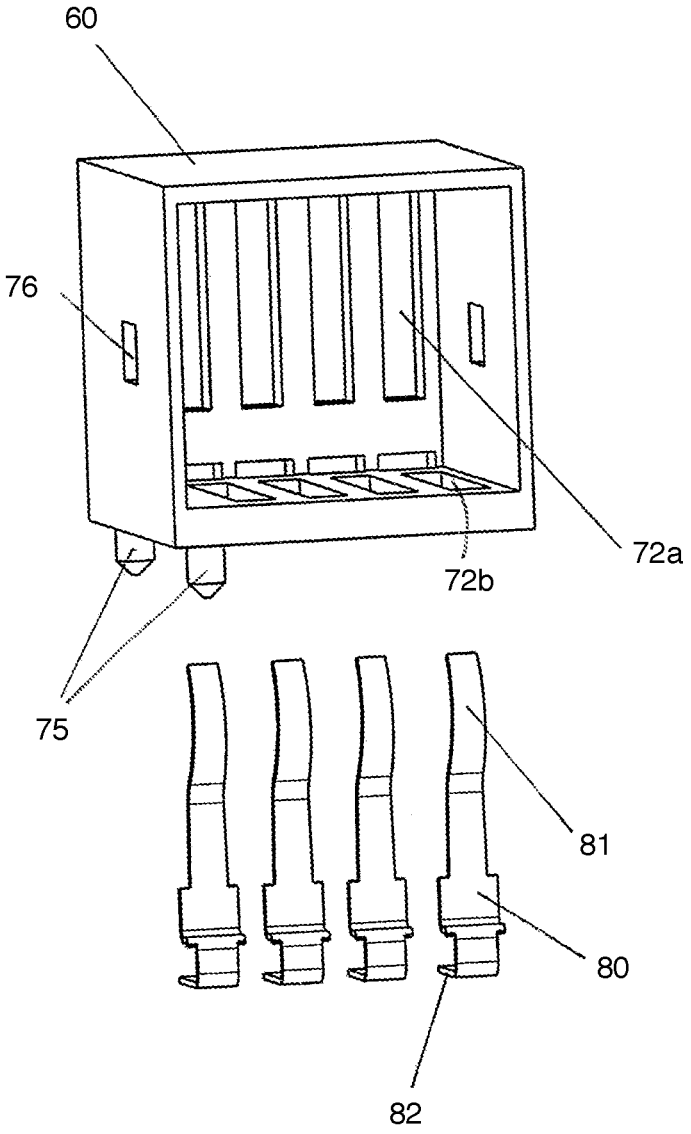
FIG. 11 is a line drawing evidencing an exploded view of the connector socket according to FIG. 10.
Figure 12:
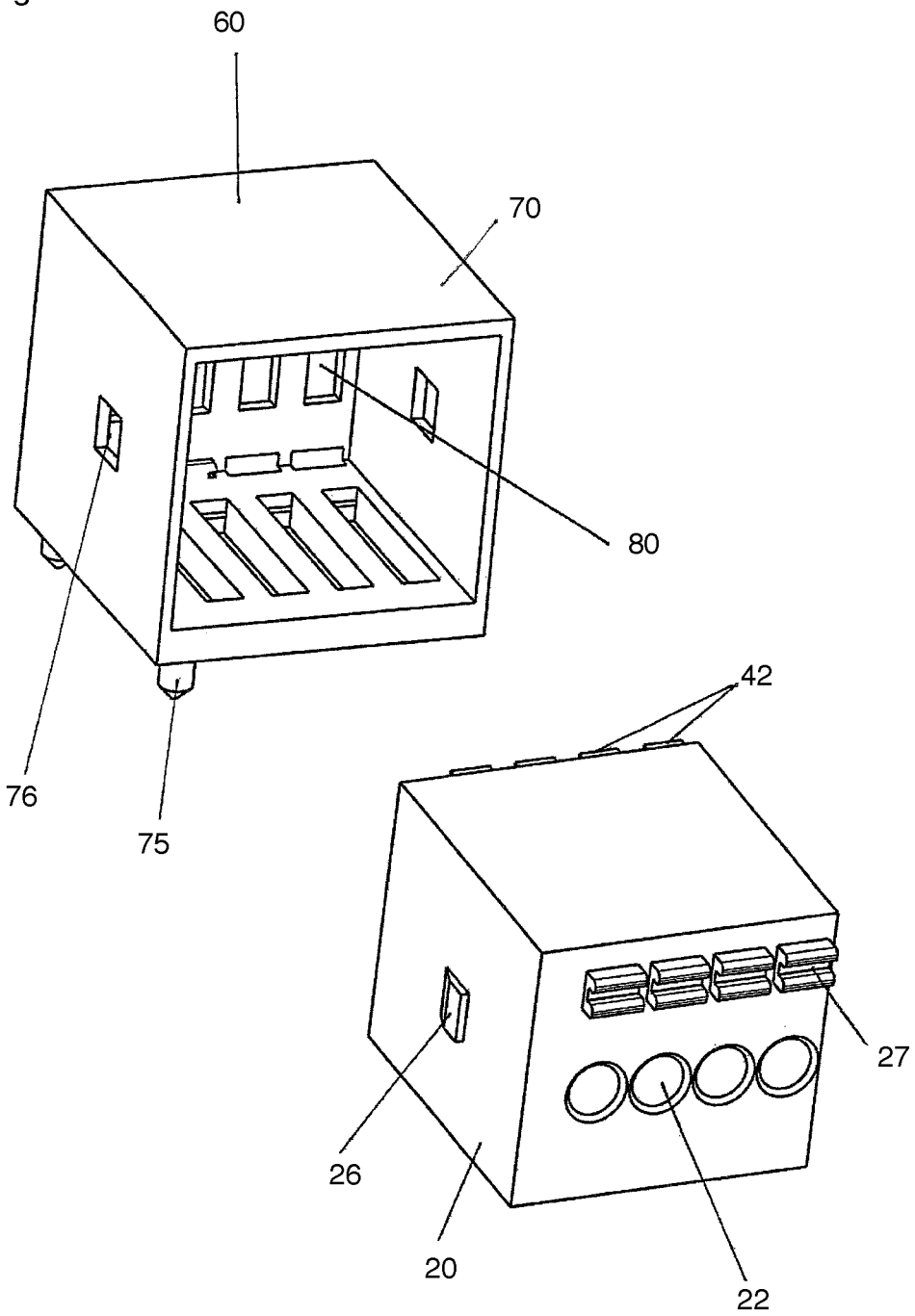
FIG. 12 is a line drawing evidencing the connector socket according to FIG. 10, having an inserted printed circuit board terminal block with multiple printed circuit board terminals.

FIGS. 10, 11, and 12 illustrate the connector socket housing 70 according to FIGS. 8 and 9, wherein the metallic contacts 80 are inserted into the rear wall 71*a* rather than into the side wall 71*b*. The concrete geometric shape of the metallic contacts 80 is accordingly adapted thereto. However, the metallic contacts 80 in turn are arranged in such a manner that the first section 81 is arranged in the interior of the connector socket housing 70, while the second section 82 which forms a solder connection site for a printed circuit board, and particularly can be soldered to the same, projects out of the connector socket housing 70.

FIG. 12 shows how a block of multiple printed circuit board terminals 10 according to the invention, which are particularly adjoined, can be inserted into the connector socket housing 70, and the connector elements 42 in this case can be contacted by the first section 81 of the metallic contacts 80 with a spring load. The printed circuit board terminals 10 can lock into locking recesses 76 of the connector socket housing 70 via locking tabs 26. The printed circuit board terminals 10 can be constructed as a pluggable embodiment, without other modifications, by inserting the printed circuit board terminals 10 according to the invention, which have flat connector elements 42 which can be directly soldered to the printed circuit board, into the connector socket housing 70.

LIST OF REFERENCE NUMBERS

10 printed circuit board terminal
20 housing
20*a* inner wall
20*b* outer wall
21*a* rear wall
21*b* side wall
21*c* side wall
21*d* side wall
21*e* side wall
22 plug opening
23 opening
24 recess
25 pin
26 locking tab
27 actuating element
28 cover
29 projection
30 clamp spring
32 contact leg
34 clamping leg
34*a* free end
40 contact element
40*a* strap
40*b* edge
42 connector element
44 connecting element
46 U-shaped element
48 Z-shaped element
49 slot
49*a* slot
49*b* slot
50 electrical conductor
60 connector socket
70 connector socket housing
71*a* rear wall
71*b* side wall
71*c* side wall
71*d* side wall
71*e* side wall
72*a* opening
72*b* opening
75 pin
76 locking recess
80 metallic contact
81 first section
82 second section The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A printed circuit board terminal, having a housing which has an inner wall and an outer wall, a clamp spring, a contact element arranged inside the housing, and a connector element arranged outside the housing, wherein the contact element and the connector element are conductively connected to each other, wherein the contact element is arranged flush with the inner wall and the connector element is arranged flush with the outer wall, and wherein an electrical conductor inserted into the printed circuit board terminal is pressed against the contact element by the clamp spring.

2. The printed circuit board terminal according to claim 1, wherein the contact element and the connector element are arranged at least partially, and preferably to a large degree or entirely, in planes which are parallel to each other.

3. The printed circuit board terminal according to claim 1, wherein the contact element lies flush on a single side wall of the housing and/or the connector element lies flush on a single side wall of the housing, wherein the contact element and the connector element preferably lie on the same side wall of the housing.

4. The printed circuit board terminal according to claim 1, wherein the contact element and the connector element are connected to each other as a single piece.

5. The printed circuit board terminal according to claim 1, wherein the contact element and the connector element are designed as punched/bended elements.

6. The printed circuit board terminal according to claim 1, wherein a strap is arranged on the contact element.

7. The printed circuit board terminal according to claim 1, wherein the contact element and/or the connector element are formed by a metallic surface attached to the housing.

8. The printed circuit board terminal according to claim 7, wherein the metallic surface is generated galvanically, chemically, by painting, gluing, or by applying a thin metal film.

9. The printed circuit board terminal according to claim 1, wherein the connector element and the contact element form legs of a U-shaped element or a Z-shaped element.

10. The printed circuit board terminal according to claim 1, wherein the housing is open to one side, and this side can be covered by a cover, wherein the electrically conducting connection between the contact element and the connector element is guided between the housing and the cover through a slot.

11. The printed circuit board terminal according to claim 10, wherein the cover is formed by an adjacent housing of a further printed circuit board terminal.

12. The printed circuit board terminal according to claim 1, further comprising wherein the housing has a plug opening for an electrical conductor to be connected.

13. The printed circuit board terminal according to claim 1, further comprising wherein the housing has an actuating element, by means of which the clamp spring can be displaced against the spring force.

14. The printed circuit board terminal according to claim 1, wherein the clamp spring is made of a metal.

15. The printed circuit board terminal according to claim 1, wherein a solder pin is arranged as a single piece on the connector element.

16. A connector socket comprising at least one printed circuit board terminal according to claim 1, wherein the connector socket has a connector socket housing which is designed to be open to one side, and which has at least one metal contact which has a first section and a second section, wherein the first section is arranged inside the connector socket housing, and when the at least one printed circuit board terminal is inserted, lies flush on the connector element of such at least one printed circuit board terminal, wherein the second section is guided outward through an opening of the connector socket housing, forming a solder connection for a printed circuit board.

17. The connector socket according to claim 16, further comprising wherein multiple metal contacts are arranged in the connector socket housing, and it is possible to plug multiple printed circuit board terminals into the connector socket, such printed circuit board terminals adjoining each other, and wherein each of the printed circuit board terminals is contacted by one metallic contact.

18. The connector socket according to claim 16, wherein the first section has a spring-elastic design.

19. The connector socket according to claim 16, wherein the first section has a spherical design.

20. The connector socket according to claim 16, wherein the opening through which the second section of the metallic contact is guided outward is arranged either in the rear wall which is opposite the open side, or in a side wall adjacent to the open side.

21. The connector socket according to claim 16, further comprising wherein one opening is arranged in the rear wall which is opposite the open side, and one opening is arranged in at least one of the side walls adjacent to the open side, wherein the second section of the metallic contact can be guided outward through the same.

22. The connector socket according to claim 16, wherein the printed circuit board terminal can be locked in the connector socket.

23. The connector socket according to claim 16, wherein the connector socket housing has pins for positioning on the printed circuit board.

* * * * *